US007220322B1

(12) United States Patent
Sun et al.

(10) Patent No.: US 7,220,322 B1
(45) Date of Patent: May 22, 2007

(54) CU CMP POLISHING PAD CLEANING

(75) Inventors: Lizhong Sun, San Jose, CA (US); Shijian Li, San Jose, CA (US); Fred C. Redeker, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 150 days.

(21) Appl. No.: 09/645,690

(22) Filed: Aug. 24, 2000

(51) Int. Cl.
*B08B 7/04* (2006.01)
*H01L 21/302* (2006.01)

(52) U.S. Cl. ..... 134/2; 134/3; 438/692

(58) Field of Classification Search ..... 134/2, 134/3, 18–26, 28, 29, 32, 33, 34; 216/52; 438/756, 690–693, 959; 156/345.12–345.13
See application file for complete search history.

(56) References Cited

U.S. PATENT DOCUMENTS

| | | | | |
|---|---|---|---|---|
| 3,889,753 A | | 6/1975 | Richardson | |
| 4,090,563 A | | 5/1978 | Lybarger et al. | |
| 4,169,337 A | | 10/1979 | Payne | 51/283 R |
| 4,541,945 A | | 9/1985 | Anderson et al. | |
| 4,588,421 A | | 5/1986 | Payne | 51/308 |
| 4,752,628 A | | 6/1988 | Payne | 523/122 |
| 4,867,757 A | | 9/1989 | Payne | 51/293 |
| 4,954,142 A | | 9/1990 | Carr et al. | |
| 5,084,071 A | | 1/1992 | Nenadic et al. | |
| 5,167,667 A | * | 12/1992 | Prigge et al. | 8/137 |
| 5,225,034 A | | 7/1993 | Yu et al. | |
| 5,264,010 A | | 11/1993 | Brancaleoni et al. | 51/308 |
| 5,340,370 A | | 8/1994 | Cadien et al. | |
| 5,478,436 A | | 12/1995 | Winebarger et al. | |
| 5,509,970 A | | 4/1996 | Shiramizu | |
| 5,527,423 A | | 6/1996 | Neville et al. | |
| 5,614,444 A | | 3/1997 | Farkas et al. | 437/225 |

(Continued)

FOREIGN PATENT DOCUMENTS

DE 39 39 661 6/1991

(Continued)

OTHER PUBLICATIONS

Ethylenediamine, internet publication www.chemicalland21.com.*

(Continued)

*Primary Examiner*—Alexander Markoff
(74) *Attorney, Agent, or Firm*—Patterson & Sheridan, LLP

(57) ABSTRACT

A polishing pad is cleaned of Cu CMP by-products, subsequent to planarizing a wafer, to reduce pad-glazing by applying to the polishing pad surface a composition comprising about 0.1 to about 3.0 wt. % of at least one organic compound having one or more amine or amide groups, an acid or a base in an amount sufficient to adjust the pH of the composition to about 5.0 to about 12.0, the remainder water. Embodiments comprise ex situ cleaning of a rotating polishing pad by applying a solution having a pH of about 5.0 to about 12.0 at a flow rate of about 100 to about 600 ml/min. for about 3 to about 20 seconds after polishing a wafer having a Cu-containing surface and then removing the cleaning solution from the polishing pad by high pressure rinsing with water.

7 Claims, 2 Drawing Sheets

U.S. PATENT DOCUMENTS

| | | | | |
|---|---|---|---|---|
| 5,645,682 | A * | 7/1997 | Skrovan | 438/692 |
| 5,662,769 | A | 9/1997 | Schonauer et al. | 438/633 |
| 5,692,947 | A * | 12/1997 | Talieh et al. | 451/41 |
| 5,700,383 | A | 12/1997 | Feller et al. | 216/88 |
| 5,738,574 | A | 4/1998 | Tolles et al. | 451/288 |
| 5,738,800 | A | 4/1998 | Hosali et al. | 216/99 |
| 5,756,398 | A | 5/1998 | Wang et al. | 438/692 |
| 5,769,689 | A | 6/1998 | Cossaboon et al. | 451/41 |
| 5,830,280 | A | 11/1998 | Sato et al. | |
| 5,840,629 | A | 11/1998 | Carpio | 438/692 |
| 5,876,508 | A | 3/1999 | Wu et al. | |
| 5,879,226 | A | 3/1999 | Robinson | |
| 5,911,835 | A | 6/1999 | Lee et al. | 134/1.3 |
| 5,932,486 | A | 8/1999 | Cook et al. | 438/692 |
| 5,958,794 | A | 9/1999 | Bruxvoort et al. | 438/692 |
| 5,981,454 | A | 11/1999 | Small | |
| 6,033,993 | A | 3/2000 | Love, Jr. et al. | |
| 6,042,741 | A | 3/2000 | Hosali et al. | 252/79.1 |
| 6,046,110 | A | 4/2000 | Hirabayashi et al. | 438/693 |
| 6,054,379 | A | 4/2000 | Yau et al. | 438/623 |
| 6,068,879 | A | 5/2000 | Pasch | 427/97 |
| 6,074,949 | A | 6/2000 | Schonauer et al. | 438/692 |
| 6,077,337 | A | 6/2000 | Lee | 106/3 |
| 6,083,840 | A | 7/2000 | Mravic et al. | 438/693 |
| 6,096,652 | A | 8/2000 | Watts et al. | 438/692 |
| 6,117,775 | A | 9/2000 | Kondo et al. | 438/690 |
| 6,117,783 | A | 9/2000 | Small et al. | 438/693 |
| 6,123,088 | A | 9/2000 | Ho | 134/1.3 |
| 6,156,661 | A | 12/2000 | Small | 438/692 |
| 6,352,595 | B1 * | 3/2002 | Svirchevski et al. | 134/3 |
| 6,498,131 | B1 * | 12/2002 | Small et al. | 510/175 |
| 6,852,682 | B2 | 2/2005 | Small et al. | |

FOREIGN PATENT DOCUMENTS

| | | |
|---|---|---|
| EP | 0 401 147 | 12/1990 |
| EP | 0 496 605 | 7/1992 |
| EP | 0 620 293 A | 10/1994 |
| EP | 0 620 293 A1 | 10/1994 |
| EP | 0 859 407 A2 | 8/1998 |
| EP | 0 860 860 | 8/1998 |
| EP | 0 913 442 A2 | 5/1999 |
| FR | 2 722 511 | 1/1996 |
| WO | 93/10277 | 5/1993 |
| WO | WO 98/49723 | 11/1998 |
| WO | WO 99/46353 | 9/1999 |
| WO | WO 00/30159 | 5/2000 |
| WO | WO 00/36037 | 6/2000 |
| WO | WO 00/49647 | 8/2000 |
| WO | WO 00/53691 | 9/2000 |
| WO | 00/59029 | 10/2000 |

OTHER PUBLICATIONS

Selwyn et al, Removal of Chloride and Iron Ions from Archaeological Wrought Iron with Sodium Hydroxide and Ethylene Diamine Solutions, Studies in Conservation, vol. 50, issue 2, May 2005.*

Kern, "Radiochemical Study of Semiconductor Surface Contamination", *RCA Review*, Jun. 1970, vol. 31, pp. 207-264.

Kaufman, F.B., et al., "Chemical-Mechanical Polishing for Fabricating Patterned W Metal Features as Chip Interconnects", *J. Electrochem. Society*, pp. 3460-3465 (1991).

Brusic, V., et al., "Copper Corrosion with and without Inhibitors", *J. Electrochem. Soc.*, vol. 138, No. 8, Aug. 1991.

Zhao, et al., "Copper CMP Cleaning Using Brush Scrubbing", Feb. 19-20, 1998 CMP-MIC Conference.

Brusic, V. et al, "Copper Corrosion With and Without Inhibitors", *Electrochem. Soc.*, 138:8, 2253-2259, Aug. 1991.

Brusic, et al. "Copper Corrosion With and Without Inhibitors," J. Electrochem. Soc., vol. 138, No. 8, Aug. 1991.

Hymes, et al., "The Challenges of the Copper CMP Clean", *Semiconductor International*, pp. 117-122 (1998).

Pak, "Impact of EDTA on Junction and Photolith Qualities", *Extended Abstracts*, Oct. 1980, vol. 80, No. 2, pp. 1241-1243.

* cited by examiner

CU CMP POLISHING PAD CLEANING

TECHNICAL FIELD

The present invention relates generally to semiconductor processing, particularly chemical-mechanical polishing (CMP). The present invention is applicable to polishing pads employed in CMP, particularly to reducing polishing defects.

BACKGROUND ART

Current semiconductor processing typically comprises forming an integrated circuit containing a plurality of conductive patterns on vertically stacked levels connected by vias and insulated by inter-layer dielectrics. As device geometry plunges into the deep sub-micron range, chips comprising five or more levels of metallization are formed.

In manufacturing multi-level semiconductor devices, it is necessary to form each level with a high degree surface planarity, avoiding surface topography, such as bumps or areas of unequal elevation, i.e., surface irregularities. In printing photolithographic patterns having reduced geometry dictated by the increasing demands for miniaturization, a shallow depth of focus is required. The presence of surface irregularities can exceed the depth of focus limitations of conventional photolithographic equipment. Accordingly, it is essential to provide flat planar surfaces in forming levels of a semiconductor device. In order to maintain acceptable yield and device performance, conventional semiconductor methodology involves some type of planarization or leveling technique at suitable points in the manufacturing process.

A conventional planarization technique for eliminating or substantially reducing surface irregularities is CMP wherein abrasive and chemical action is applied to the surface of the wafer undergoing planarization. The polishing pad is employed together with a chemical agent to remove material from the wafer surface.

FIG. 1 is a schematic top plan view of a conventional CMP apparatus 11 comprising a rotatable platen 15 on which is mounted a polishing pad 17 for polishing semiconductor substrate S. The polishing pad 17 can be a conventional slurry-type pad having a plurality of concentric circumferential grooves 19 as illustrated, or a fixed abrasive-type polishing pad.

CMP apparatus 11 further comprises a pivot arm 21, a holder or conditioning head 23 mounted to one end of the pivot arm 21, a pad conditioner 25, such as a pad embedded with diamond crystals, mounted to the underside of the conditioning head 23, a slurry source such as a slurry/rinse arm 27, and a substrate mounting head 29 operatively coupled to platen 15 to urge substrate S against the working surface of polishing pad 17. Pivot arm 21 is operatively coupled to platen 15, and maintains conditioning head 23 against the polishing pad 17 as the pivot arm 21 sweeps back and forth across the radius of polishing pad 17 in an arcing motion. Slurry/rinse arm 27 is stationarily positioned outside the sweep of the pivot arm 21 and the conditioning head 23 coupled thereto.

In operation, the substrate S is placed face down beneath the substrate mounting head 29, and the substrate mounting head 29 presses the substrate S firmly against the polishing pad 17. Slurry is introduced to the polishing pad 17 via slurry/rinse arm 27, and platen 15 rotates as indicated by arrow $R_1$. Pivot arm 21 scans from side to side in an arcing motion as indicated by arrow $S_1$.

When the pad is grooved, then grooves 19 channel the slurry (not shown) between the substrate S and the polishing pad 17. The semi-porous surface of the polishing pad 17 becomes saturated with slurry which, with the downward force of the substrate mounting head 29 and the rotation of the platen 15, abrades and planarizes the surface of the substrate S. The diamond crystals (not shown) embedded in the rotating conditioner 25 continually roughen the surface of the polishing pad 17 to ensure consistent polishing rates. Pad cleaning must be performed frequently to clean polishing residue and compacted slurry from the polishing pad 17.

Conventional pad cleaning techniques employ rinsing wherein the substrate mounting head 29 is removed from contact with the polishing pad 17, the supply of slurry from the slurry/rinse arm 27 is turned off, and a rinsing fluid such as deionized water is supplied via the slurry/rinse arm 27. However, merely rinsing the polishing pad following CMP is often ineffective in removing polishing residues, particularly after CMP of metal films, because polishing by-products stick to the polishing pad.

Conventional polishing pads employed in abrasive slurry processing typically comprise a grooved porous polymeric surface, such as polyurethane, and the abrasive slurry varied in accordance with the particular material undergoing CMP. Basically, the abrasive slurry is impregnated into the pores of the polymeric surface while the grooves convey the abrasive slurry to the wafer undergoing CMP. Another type of polishing pad is a fixed abrasive pad wherein abrasive elements are mounted on a backing. When conducting CMP with a fixed abrasive pad, a chemical agent without abrasive particles is applied to the pad surface.

When conducting CMP on a metal-containing surface, e.g., Cu or a Cu alloy, the working or polishing surface of the polishing pad undergoes changes believed to be caused by, inter alia, polishing by-products resulting from the reaction of metal being removed from the wafer surface, such as Cu, with components of the CMP slurry or chemical agent, e.g., oxidizer, complexing agents and inhibitors. Such by-products typically deposit onto the polishing pad and accumulate causing a colored stain or glazed area. Such a surface exhibits a lower coefficient of friction and, hence, a substantially lower material removal rate by adversely impacting polishing uniformity and increasing polishing time. In addition, such glazing causes scratching of the wafer surface. Conventional approaches to remedy pad glazing include pad conditioning, as with nylon brushes or diamond disks for removing the deposited by-products from the polishing pad surface. However, such a conventional remedial approach to the glazing problem is not particularly effective in completely removing glazing. Pad conditioning with a diamond disk also greatly reduces pad lifetime.

There exists a need for methodology enabling the planarization of a wafer surface containing Cu or Cu alloy with reduced pad glazing. There exists a particular need for methodology enabling CMP of a wafer surface containing Cu or Cu alloys at high production throughput.

SUMMARY OF THE INVENTION

An aspect of the present invention is a method of cleaning a polishing pad surface to prevent or substantially reduce pad glazing stemming from conducting CMP on a wafer surface containing Cu or Cu alloy.

Another aspect of the present invention is an apparatus for conducting a CMP on a wafer surface containing Cu or Cu alloy with significantly reduced pad glazing.

Additional aspects of the present invention will be set forth in the description which follows and in part will be apparent to those having ordinary skill in the art upon examination of the following or may be learned from the practice of the present invention. The aspects of the present invention may be realized and obtained as particularly pointed out in the appended claims.

According to the present invention, the foregoing and other aspects are achieved in part by a method of cleaning a polishing pad surface subsequent to CMP a wafer surface containing Cu or a Cu alloy, the method comprising applying to the polishing pad surface a cleaning composition comprising: about 0.2 to about 3.0 wt. % of at least one organic compound containing one or more amine or amide groups; an acid or a base in amount such that the composition has a pH of about 5.0 to about 12.0; and water, e.g., deionized water.

Another aspect of the present invention is a method comprising the sequential steps: (a) conducting CMP on a first wafer surface containing Cu or a Cu alloy on a surface of a polishing pad; (b) applying to the polishing pad surface a cleaning composition comprising: about 0.2 to about 3.0 wt. % of at least one organic compound containing one or more amine or amide groups; an acid or a base in an amount such that the composition has a pH of about 5.0 to about 12.0 and water; (c) rinsing the polishing pad surface with water to remove any cleaning composition on the polishing pad surface; (d) conducting CMP on a second wafer surface; and (e) repeating steps (b) through (d).

A further aspect of the present invention is an apparatus for conducting CMP on a wafer surface containing Cu or a Cu alloy, the apparatus comprising: a platen; a polishing sheet or pad mounted on the platen; a first dispenser adapted to dispense a cleaning composition on a working surface of the polishing sheet or pad; and a source of the cleaning composition coupled to the first dispenser, the cleaning composition comprising: about 0.2 to about 3.0 wt. % of at least one organic compound containing one or more amine or amide groups; an acid or a base in an amount sufficient such that the cleaning composition has a pH of about 5.0 to about 12.0; and water.

Embodiments of the present invention comprise conducting CMP on a plurality of wafers having a surface containing Cu or a Cu alloy. After each wafer is subjected to CMP, the polishing pad surface is cleaned with a cleaning solution having a pH of about 5.0 to about 12.0, e.g., about 8 to about 11, containing at least one organic compound having one or more amine or amide groups, such as ethylenediamine, an acid such as phosphoric acid, acetic acid and sulfuric acid, or a base, such as potassium, sodium or ammonium hydroxide, and water. The cleaning solution is then rinsed away from the polishing pad surface with pressurized water. Pad conditioning can also be implemented before, during and/or after applying the cleaning solution. Embodiments of the present invention further include an apparatus containing a first dispenser for dispensing the cleaning solution and, a second dispenser for rinsing the polishing pad surface after application of the cleaning solution, and a computer programmed to implement CMP, polishing pad surface cleaning and polishing pad surface rinsing.

Additional aspects of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without departing from the present invention. Accordingly, the drawings and description are to be regarded as illustrative in nature, and not as restrictive.

DESCRIPTION OF THE INVENTION

Figure 1:
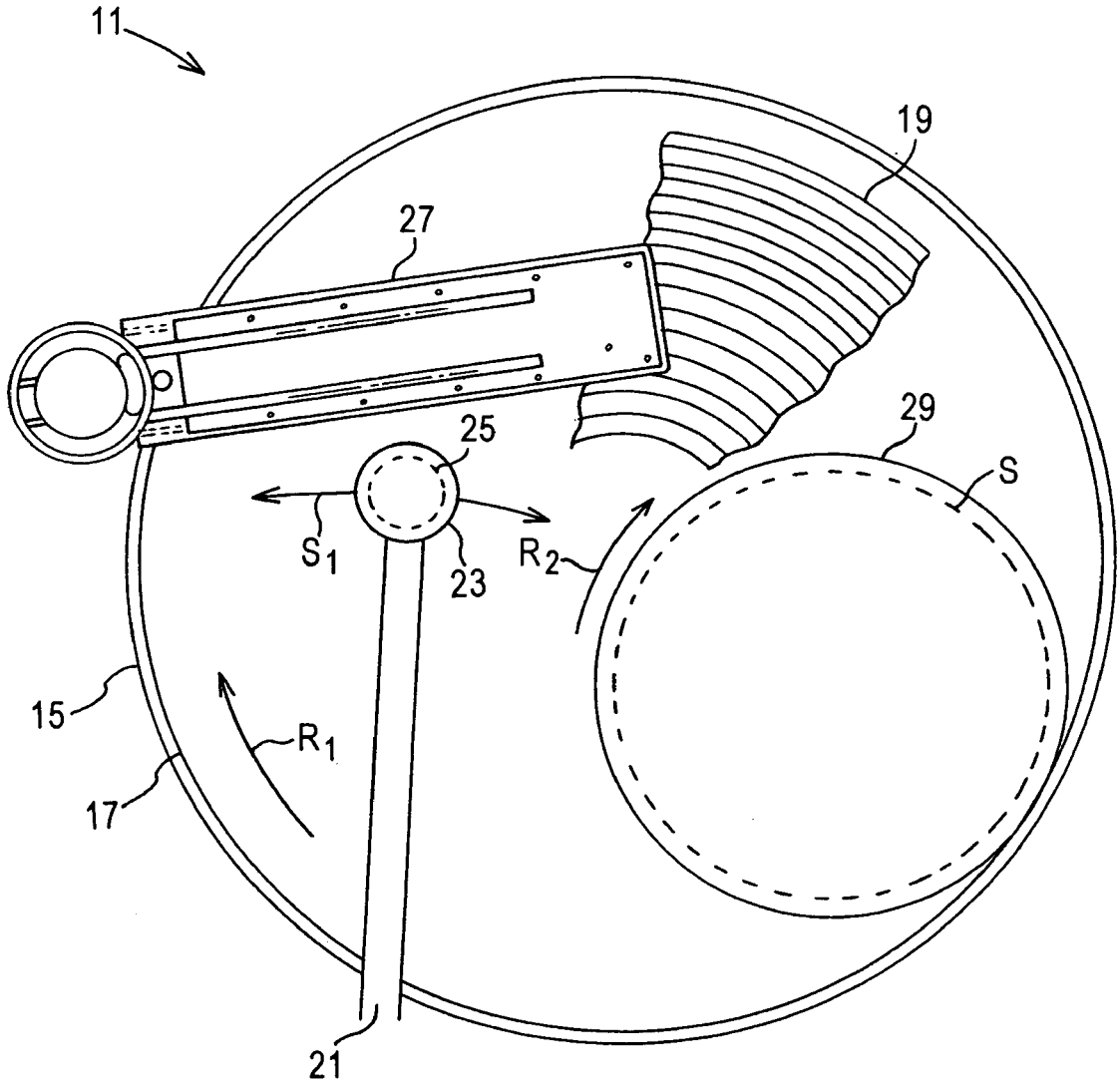
FIG. 1 (PRIOR ART)
FIG. 1 schematically illustrates a conventional CMP apparatus.

The present invention addresses and solves the pad glazing problem attendant upon conducting CMP on a wafer surface containing Cu and/or Cu alloys. As employed throughout this disclosure, the symbol Cu is intended to encompass high purity elemental copper as well as copper-based alloys, e.g., copper alloys containing about 80% of copper and greater. As also employed throughout this disclosure, the expression "ex situ" treatment is intended to encompass polishing pad treatment conducted while a wafer is not in contact with the polishing pad and/or undergoing CMP.

Pad glazing attendant upon conducting CMP of a wafer surface containing Cu adversely impacts the uniformity and polishing rate of CMP. Accordingly, pad conditioning is conventional conducted, notably with a diamond disk. It is believed that pad glazing stems from the accumulation of polishing by-products, particularly Cu-complexes with slurry components, such as complexing agents and inhibitors.

The present invention addresses and solves the pad glazing problem attendant upon conducting CMP of a wafer surface containing Cu by addressing the source of the problem, i.e., by removing the Cu-containing polishing by-products before such polishing by-products transform into a glazing on the pad surface. In accordance with embodiments of the present invention, after conducting CMP on a wafer surface containing Cu, the polishing pad working surface is treated with a cleaning composition comprising about 0.1 to about 3.0, e.g., about 0.5 to about 1.0 wt. % of at least one organic compound containing one or more amine or amide groups, an acid or a base in a sufficient amount such that the composition has a pH of about 5.0 to about 12.0 and water. Subsequent to cleaning, the polishing pad surface is rinsed with water, as by water under pressure, to remove the cleaning solution prior to initiating CMP on a subsequent wafer.

Embodiments of the present invention further include optional conditioning the pad surface to remove any glazing which may occur, as by employing a conventional disk, before, during and/or after treatment with the cleaning composition.

Embodiments of the present invention comprise treating the polishing pad surface with a solution having a pH of about 5.0 to about 12.0, e.g., about 8 to about 11, and containing ethlyenediamine and phosphoric acid, acetic acid or sulfuric acid, the remainder deionized water. Given the present disclosure and objectives, the optimum flow rate and time for treating a polishing pad surface can be determined in a particular situation. For example, it was found suitably to apply the cleaning solution to a rotating polishing pad at a flow rate of about 100 to about 600 ml/min, e.g., about 100 to about 200 ml/min, for about 3 to about 20 seconds. The solution can then be removed from the polishing pad surface by applying pressurized deionized water for about 2 to about 20 seconds.

It was found that the sequential treatment of a polishing pad surface with a cleaning solution containing at least one organic compound having one or more amine or amide groups, an acid or a base and water followed by rinsing with water significantly reduces pad glazing, increases wafer to wafer rate uniformity and reduces wafer scratches. The exact mechanism underpinning the significant reduction in pad glazing attendant upon employing a cleaning solution in accordance with embodiments of the present invention is not known with certainty. However, it is believed that the organic compound or compounds containing at least one amine or amide groups, such as ethylenediamine, forms water soluble complexes with Cu and/or the Cu-containing CMP by-products, which complexes dissolve in water. Upon subsequent rinsing with water, the remaining cleaning composition and solubized by-products are removed, thereby preventing and/or significantly reducing the formation of pad glazing in an efficient, cost effective manner.

Embodiments of the present invention, therefore, comprise a method of conducting CMP on a plurality of individual wafers having a surface containing Cu. After each wafer is planarized, the polishing pad surface is treated with a cleaning solution and then rinsed, in accordance with embodiments of the present invention, to prevent and/or significantly reduce pad glazing, thereby improving wafer to wafer rate uniformity and reducing wafer scratches.

Embodiments of the present invention further include polishing apparatus comprising various types of platens, including linear platens and apparatuses comprising at least one platen, a polishing pad or sheet mounted on the platen, a first dispenser for dispensing a cleaning solution containing the organic compound or compounds having one or more amine groups, an acid or a base sufficient to achieve a solution pH of about 5.0 to about 12.0, and water, a second dispenser for dispensing water, e.g., pressurized water, on the polishing pad surface to remove the cleaning solution and dissolved CMP by-products prior to initiating CMP of a subsequent wafer. An apparatus in accordance with embodiments of the present invention can also include a controller programmed for dispensing the cleaning solution onto the polishing pad surface and for rinsing the polishing pad surface to remove the remaining cleaning solution and dissolved polishing by-products prior to initiating CMP of a subsequent wafer. The apparatus can also be programmed for implementing polishing pad conditioning before, during and/or after treatment of the pad surface with a cleaning solution.

Figure 2:
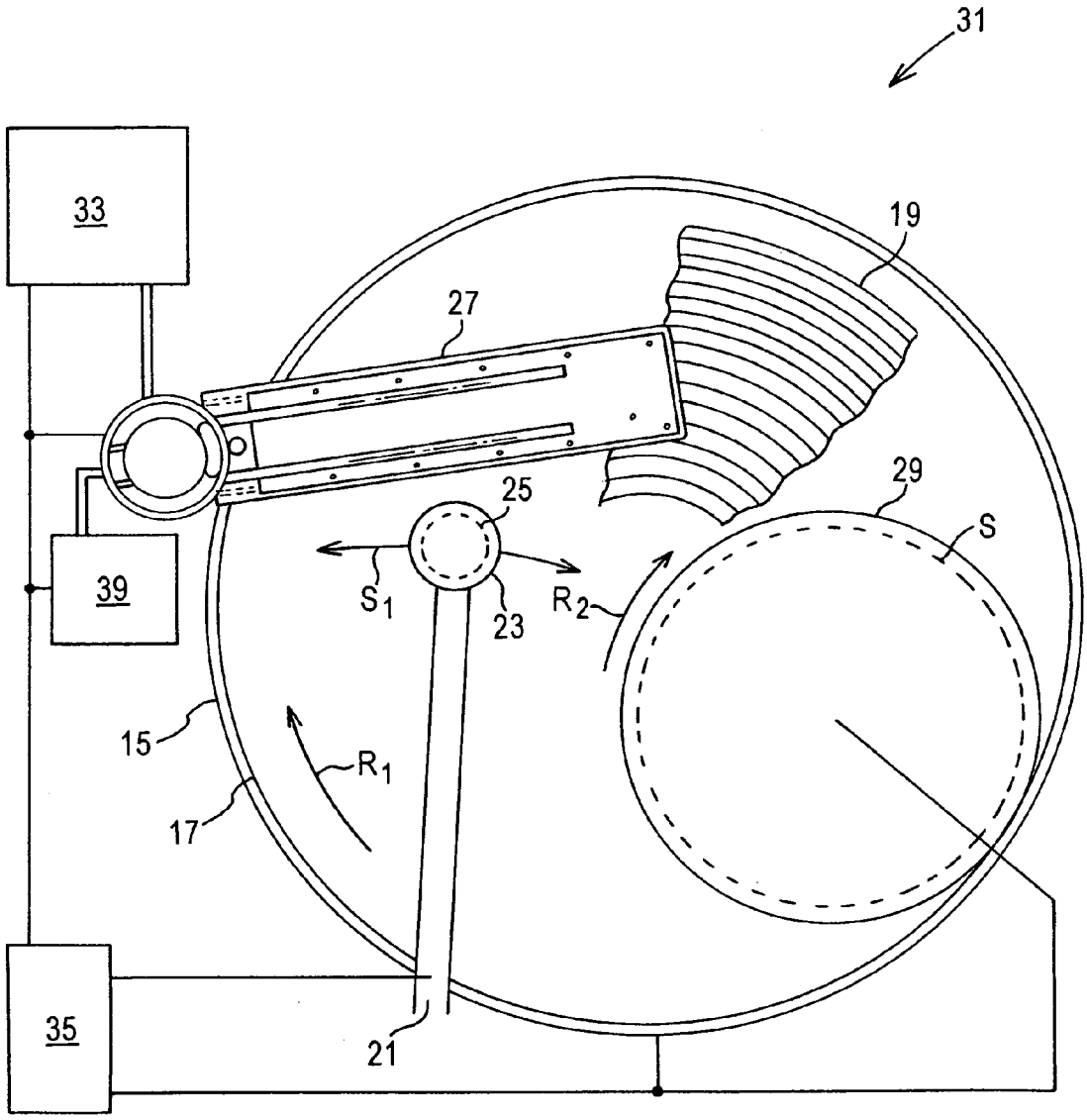
FIG. 2 schematically illustrates a CMP apparatus in accordance with an embodiment of the present invention.

An apparatus in accordance with an embodiment of the present invention is schematically illustrated in FIG. 2. The inventive apparatus 31 comprises many components described with reference to the conventional apparatus 11 illustrated in FIG. 1. However, the inventive apparatus 31 further comprises a source of cleaning solution 33, having a pH of about 5.0 to about 12.0 and comprising at least one organic compound having at least one amine or amide groups, e.g., ethylenediamine, an acid, e.g., phosphoric acid, acetic acid or sulfuric acid, or a base, such as potassium, sodium, or ammonium hydroxide, and water, e.g., deionized water, coupled to slurry/rinse arm 27, and a controller 35 coupled to the platen 15, pivot arm 21, slurry/rinse arm 27 and the source of cleaning solution 33. Additionally, source of rinsing fluid 39 (e.g., a source of deionized water) is coupled to the slurry/rinse arm 27 and the controller 35. Controller 35 can be programmed for controlling all aspects of operation, including CMP of a substrate S on polishing pad 17, conditioning the polishing pad 17 via pivot arm 21, dispensing (via slurry/rinse arm 27) cleaning solution from the source of cleaning solution 33, and dispensing rinsing fluid from the source of rinsing fluid 39.

In operation, a substrate S is placed face down beneath the substrate mounting head 29, and the substrate mounting head 29 presses the substrate S firmly against the polishing pad 17. Slurry is introduced to the polishing pad 17 via slurry/rinse arm 27, and platen 15 rotates as indicated by arrow $R_1$. Pivot arm 21 scans from side to side in an arcing motion as indicated by arrow $S_1$.

If the pad is grooved, the grooves 19 channel the slurry (not shown) between the substrate S and the polishing pad 17. The semi-porous surface of the polishing pad 17 becomes saturated with slurry which, with the downward force of the substrate mounting head 29 and the rotation of the platen 15, abrades and planarizes the surface of the substrate S. The diamond crystals (not shown) embedded in the rotating conditioner 25 continually roughen the surface of the polishing pad 17 to ensure consistent polishing rates, if necessary.

Unlike conventional pad cleaning techniques which merely use a rinsing fluid such as de-ionized water to remove slurry particles and polishing residue, the inventive apparatus 31 employs a cleaning solution having a chemistry adapted to improve pad cleaning. Specifically, the cleaning solution has a chemistry adapted to solubilize Cu-containing CMP residue on the surface of polishing pad 17 before glazing occurs. In this manner, even difficult to remove Cu-containing compounds in the solid state, can be cleaned from the polishing pad 17 in an efficient, cost effective manner. Subsequently, the surface of polishing pad 17 is rinsed as with pressurized deionized water dispensed from slurry/rinse arm 27.

The present invention advantageously significantly reduces polishing pad glazing at its source by solubilizing and removing Cu-containing CMP residue before glazing occurs on the polishing pad surface. The present invention can be implemented in a cost effective, efficient manner employing conventional materials and chemicals, with minor modifications to existing CMP devices. The present invention significantly improves wafer-to-wafer CMP rate uniformity and, at the same time, significantly reduces wafer scratches, in a cost effective and efficient manner.

The present invention is applicable to the manufacture of various types of semiconductor devices. The present invention is particularly applicable to manufacturing multi-level semiconductor devices having sub-micron features.

In the previous description, numerous specific details are set forth, such as specific materials, structures, chemicals, processes, etc., to provide a better understanding of the present invention. However, the present invention can be practiced without resorting to the details specifically set forth. In other instances, well known methodology, materials and features have not been described in detail in order not to unnecessarily obscure the present invention.

Only the preferred embodiment of the present invention and but a few examples of its versatility are shown and described in the present disclosure. It is to be understood that the present invention is capable of use in various other combinations and environments and capable of changes or modifications within the scope of the inventive concept as expressed herein.

What is claimed is:

1. A method of cleaning a polishing pad surface subsequent to chemical-mechanical polishing (CMP) a wafer surface containing copper (Cu) or a Cu-based alloy, the method comprising applying to the polishing pad surface a cleaning composition comprising:

about 0.1 to about 3.0 wt. % of ethylenediamine;

an acid in an amount such that the composition is a solution having a pH of about 8 to about 11; and deionized water.

2. The method according to claim 1, comprising applying the solution to a rotating polishing pad at a flow rate of about 100 to about 600 ml/min.

3. The method according to claim 2, comprising applying the solution to the polishing pad for about 3 seconds to about 20 seconds after conducting CMP on each of a plurality to wafers having a surface comprising Cu or Cu alloy.

4. A method comprising:

(a) conducting chemical-mechanical polishing (CMP) on a first wafer surface of a first wafer containing copper (Cu) or a Cu-based alloy on a surface of a polishing pad;

(b) removing the first wafer from the pad;

(c) applying to the polishing pad surface a cleaning composition, wherein the cleaning composition is a solution comprising:

about 0.1 to about 3.0 wt. % of ethylenediamine;

an acid in an amount such that the composition is a solution having a pH of about 8 to about 11; and deionized water;

(d) rinsing the polishing pad surface with water to remove any cleaning composition on the polishing surface;

(e) conducting CMP on a second wafer; and then (f) repeating (b) through (e).

5. The method according to claim 4, comprising applying the solution to a rotating polishing pad at a flow rate of about 100 to about 600 ml/min.

6. The method according to claim 5, comprising applying the composition to the rotating polishing pad for about 3 seconds to about 20 seconds.

7. A method of cleaning a surface of a polishing pad, comprising:

conducting chemical-mechanical polishing (CMP) on a first wafer on the surface of the polishing pad;

removing the first wafer from the polishing pad;

applying to the polishing pad surface a cleaning composition, wherein the cleaning composition is a solution comprising:

about 0.1 to about 3.0 wt. % of ethylenediamine;

an acid in an amount such that the composition is a solution having a pH of about 8 to about 11; and deionized water; and cleaning the polishing pad surface with the cleaning composition.

* * * * *

UNITED STATES PATENT AND TRADEMARK OFFICE

CERTIFICATE OF CORRECTION

PATENT NO. : 7,220,322 B1
APPLICATION NO. : 09/645690
DATED : May 22, 2007
INVENTOR(S) : Sun et al.

It is certified that error appears in the above-identified patent and that said Letters Patent is hereby corrected as shown below:

In Item (56) References Cited:

In the U.S. Patent Documents, please insert the following references:

--6280299 08/2001 Kennedy et al.

6220941 04/2001 Fishkin et al.--

Signed and Sealed this

Eleventh Day of August, 2009

David J. Kappos

David J. Kappos
*Director of the United States Patent and Trademark Office*